US007681853B2

(12) United States Patent
Trusty et al.

(10) Patent No.: US 7,681,853 B2
(45) Date of Patent: Mar. 23, 2010

(54) SLIDING LADDER AND EQUIPMENT RACK

(76) Inventors: Jason Trusty, 1426 W. Highland Ave., Chicago, IL (US) 60660; Eric Trusty, 1426 W. Highland Ave., Chicago, IL (US) 60660

( * ) Notice: Subject to any disclaimer, the term of this patent is extended or adjusted under 35 U.S.C. 154(b) by 141 days.

(21) Appl. No.: 10/938,109

(22) Filed: Sep. 10, 2004

(65) Prior Publication Data

US 2005/0139559 A1 Jun. 30, 2005

Related U.S. Application Data

(60) Provisional application No. 60/501,987, filed on Sep. 11, 2003.

(51) Int. Cl.
*A47H 1/10* (2006.01)

(52) U.S. Cl. ..... 248/323; 248/340; 182/127; 414/462

(58) Field of Classification Search ..... 211/113, 211/13.1; 248/340, 317, 320, 322, 323, 229.22; 224/310, 315, 324, 325; 410/120, 34, 35, 410/77; 414/462, 546; 182/127
See application file for complete search history.

(56) References Cited

U.S. PATENT DOCUMENTS

| | | | | | |
|---|---|---|---|---|---|
| 1,272,359 | A * | 7/1918 | Bell | 294/103.1 |
| 2,840,288 | A | 6/1958 | Broddon | 224/42.1 |
| 2,998,885 | A | 9/1961 | Surface | 211/64 |
| 3,058,607 | A * | 10/1962 | Kiley | 414/462 |
| 3,433,446 | A * | 3/1969 | Meder | 248/316.3 |
| 3,888,398 | A | 6/1975 | Payne | 224/42.1 |
| 3,904,094 | A | 9/1975 | Correll | 224/42.1 |
| 3,924,390 | A * | 12/1975 | Alexander | 56/340.1 |
| 4,135,655 | A * | 1/1979 | Brown | 294/166 |
| 4,139,078 | A * | 2/1979 | Keller | 182/88 |
| 4,413,801 | A | 11/1983 | Lancaster et al. | 248/316 A |
| 4,489,970 | A * | 12/1984 | Henke | 294/67.22 |
| 4,576,319 | A * | 3/1986 | Brown | 224/538 |
| 4,615,335 | A * | 10/1986 | Searcy | 601/32 |
| 4,923,103 | A | 5/1990 | Sauber | 224/42.45 R |
| 5,172,952 | A * | 12/1992 | Lasnetski | 296/37.8 |
| 5,242,094 | A | 9/1993 | Finley | 224/324 |
| 5,277,463 | A * | 1/1994 | Singh et al. | 294/103.1 |
| 5,393,050 | A * | 2/1995 | Lloyd | 473/429 |
| 5,441,322 | A * | 8/1995 | Jobmann et al. | 294/90 |
| 5,632,591 | A | 5/1997 | Henriquez | 414/462 |
| 5,722,917 | A * | 3/1998 | Olschansky et al. | 482/72 |
| 5,850,891 | A * | 12/1998 | Olms et al. | 182/127 |
| 6,250,655 | B1 * | 6/2001 | Sheeks | 280/79.7 |
| 6,315,181 | B1 * | 11/2001 | Bradley et al. | 224/310 |
| 6,511,271 | B1 | 1/2003 | Saroka | 410/120 |
| 6,601,892 | B2 * | 8/2003 | Scarborough | 294/103.1 |
| 2005/0079036 | A1 | 4/2005 | Richter | 414/462 |

* cited by examiner

*Primary Examiner*—Korie Chan
(74) *Attorney, Agent, or Firm*—Husch Blackwell Sanders Welsh & Katz

(57) ABSTRACT

A ladder and equipment storage rack and method. In one form of the invention, a ladder and equipment rack is provided with mounts that connect to struts or other hanger devices to easily adapt to hold a ladder or other equipment. The storage rack can be used in vehicles, buildings or any other locations for storage.

9 Claims, 7 Drawing Sheets

SLIDING LADDER AND EQUIPMENT RACK

FIELD OF INVENTION

The present invention relates to storage devices and more particularly to devices that can quickly store ladders and various equipment.

BACKGROUND

Ladder and equipment storage devices are known. Ladder storage devices are commonly used to securely hold and store a ladder in a convenient location for short or extended period of time. Such storage devices may be used in a variety of different places such as, for example, a vehicle or a building.

One problem with existing devices that store ladders inside of or on vehicles is that mounting and removing the ladder can be difficult and time consuming when dealing with confined spaces such as in the back of a vehicle or where reaching storage hooks or other hanging devices may be impractical. Another problem with existing devices is that if a vehicle's storage space compartment is crowded with objects and materials, usage of such existing products is cumbersome and they typically don't provide both horizontal and vertical mounting options to make full use of the available cargo space. Another problem with existing devices is that many ladder mounts are for storing ladders outside of the vehicle thereby exposing them to the weather and increasing the likelihood of theft. Also, many existing devices require additional clamping or strapping to hold a ladder firmly in place and require excessive time to store or remove a ladder.

The present invention overcomes the problems of existing devices, the sliding ladder and equipment rack substantially departs from the conventional concepts and designs of the prior art, and in so doing provides an apparatus and method developed for the purpose of providing an adjustable sliding mount that connects to universally available hanger strut to easily slide and hold a ladder inside a vehicle without having to enter the vehicle or use additional means to hold the ladder securely in position.

In one form of the invention, a sliding ladder and equipment rack is provided with an adjustable sliding mount that connects to universally available hanger strut to easily slide and hold a ladder or other equipment inside a vehicle without having to enter the vehicle or use additional straps or clamping devices to maintain a secure mount. In one embodiment, the ladder rack can be used on the interior ceiling of a vehicle which is the area typically least occupied on most vehicles when the cargo space is packed with items, but may also be mounted in many other environments and locations. For example, the present invention may be mounted in garages, basements, homes, warehouses or any other place where ladders or equipment are stored. In one embodiment, placing the ladder inside the vehicle and near the roof of the vehicle keeps the ladder clean, and avoids damage to the ladder by not being in contact with other items stored in the same cargo space.

Other advantages of the present invention will become obvious to the reader and it is intended that these advantages are within the scope of the present invention. To the accomplishment of the above and related advantages, this invention may be embodied in the form illustrated in the accompanying drawings, attention being called to the fact, however, that the drawings are illustrative only of some embodiments, and that changes may be made in the specific construction illustrated.

DETAILED DESCRIPTION OF THE INVENTION

Figure 1:
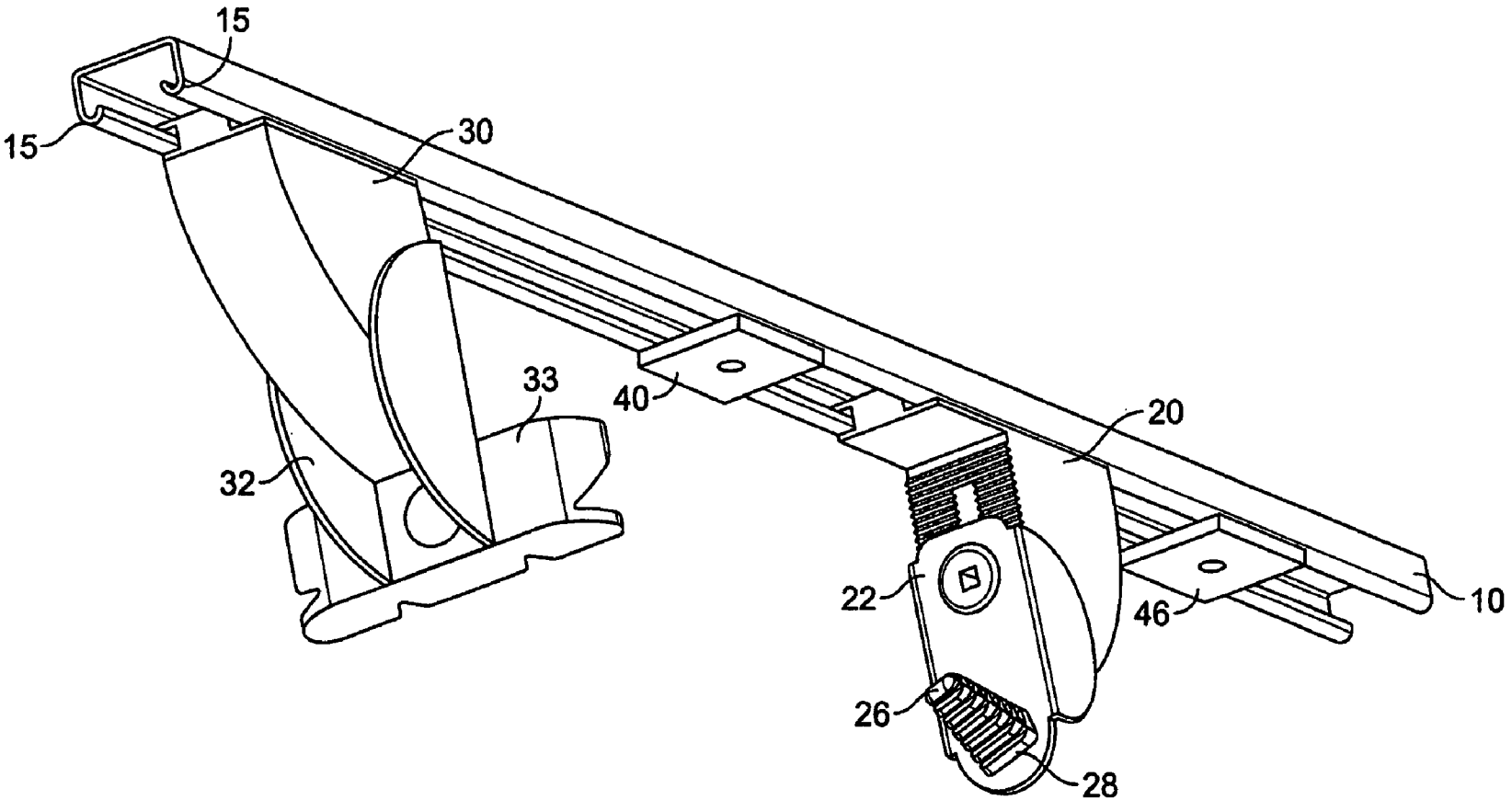
FIG. 1 is a perspective view of one embodiment of the present invention without a shock cord installed.
Figure 2:
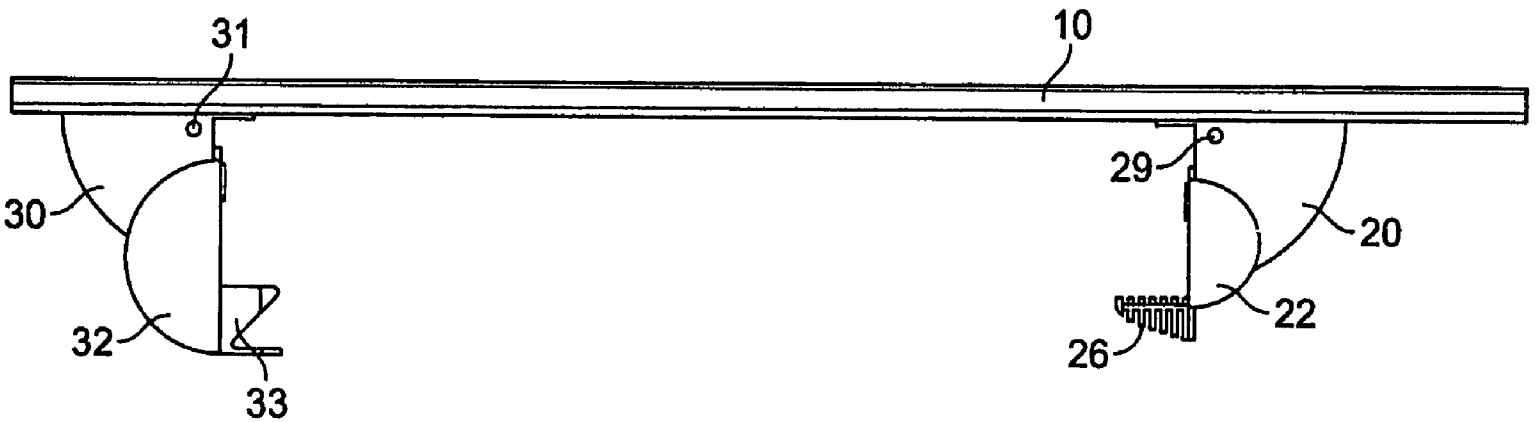
FIG. 2 is a side view of one embodiment of the present invention of FIG. 1.
Figure 3:
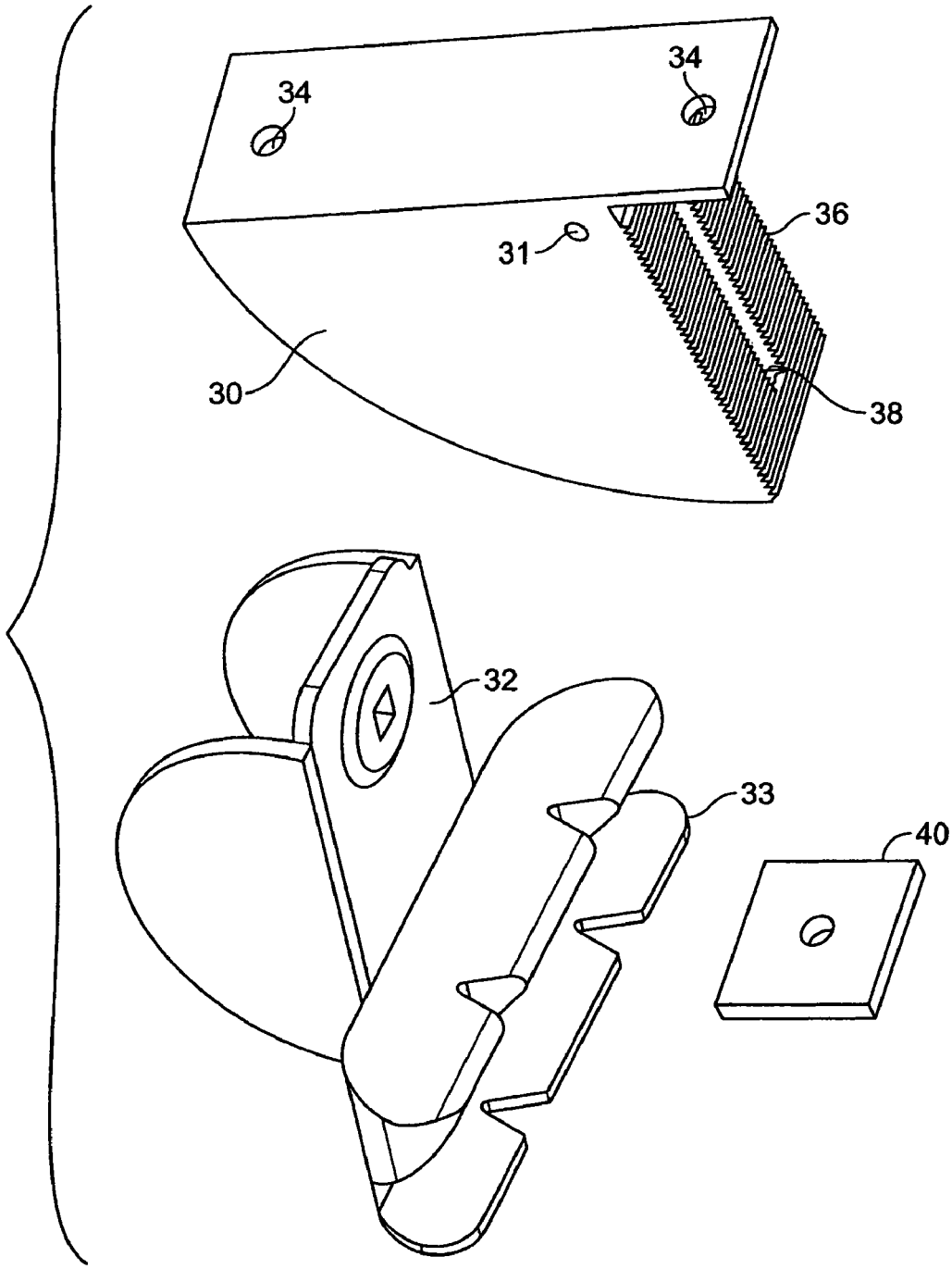
FIG. 3 is a perspective view of one embodiment of the fixed mount, the catch head, catch, and the rear stop.

While the present invention is susceptible of embodiments in various forms, there is shown in the drawings and will hereinafter be described some exemplary and non-limiting embodiments, with the understanding that the present disclosure is to be considered an exemplification for the invention and is not intended to limit the invention to the specific embodiments illustrated. In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

Figure 4:
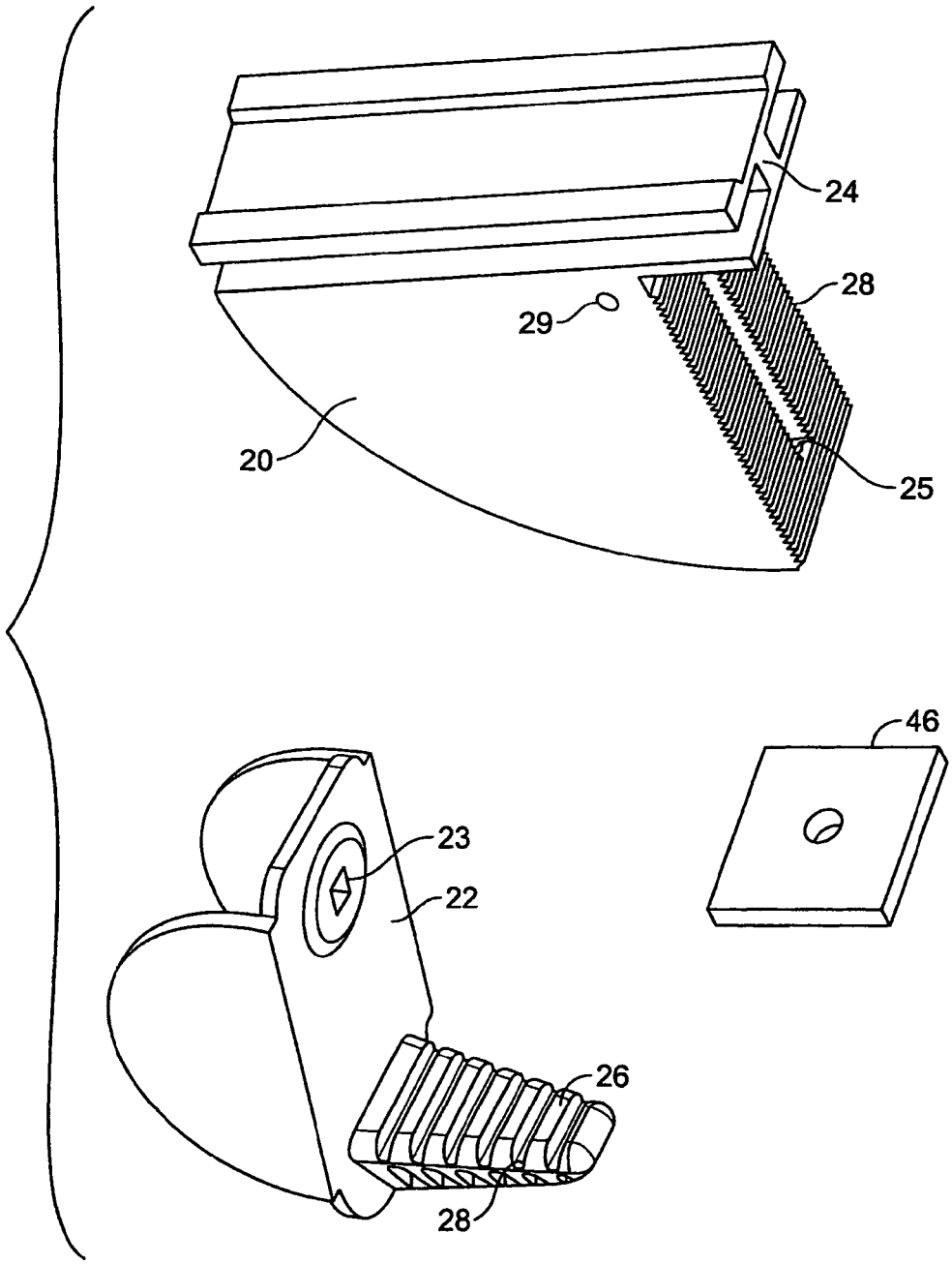
FIG. 4 is a perspective view of one embodiment of the sliding front mount, the receiving head with peg section, and the front stop.
Figure 5:
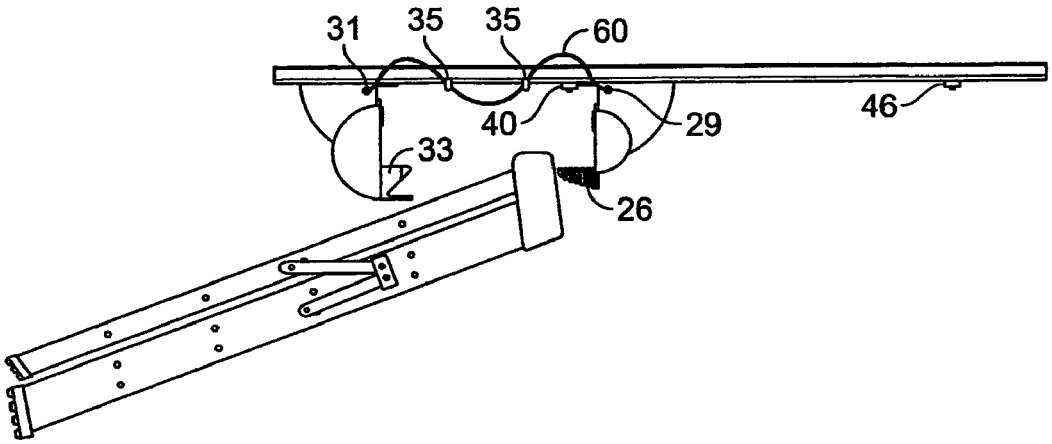
FIG. 5 is an operational side view of one embodiment of the invention with the sliding mount positioned at the rear stop.
Figure 6:
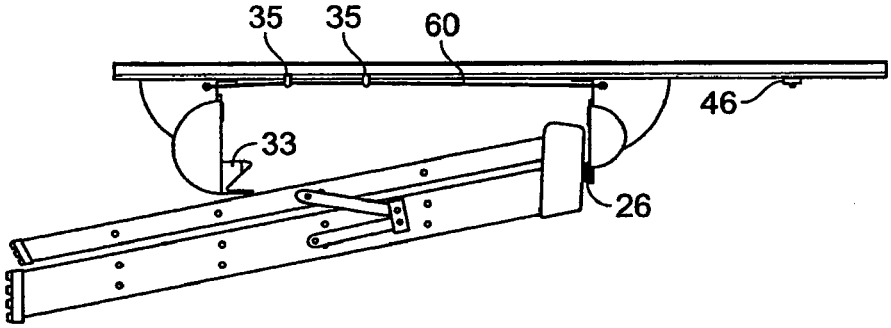
FIG. 6 is an operational side view of one embodiment of the invention with the sliding mount between the front and rear stop.

Shown in FIGS. 1-10 is a sliding ladder and equipment rack 5, which comprises in one embodiment, a sliding front mount 20, an adjustable receiving head 22, a peg section 26, a fixed mount 30, an adjustable catch head 32, a catch 33, a front stop 46, and rear stop 40. An elastic shock cord 60 is also provided as shown in FIGS. 4-6. The slidable mount 20 is designed to fit inside between the rails on a 1⅝" hanger strut 10 and has a "H" cross section shape 24 that, when inserted between the rails 15 on strut 10, the "H" shaped cross section portion 24 cannot fall out of strut 10 but remains free to easily slide linearly along strut rails 15. As shown in FIG. 4, slidable mount 20 has a slot 25 for a bolt or other connector that connects the adjustable receiving head 22 at hole 23, and having a grooved peg section 26 to prevent slippage of the ladder when it is mounted. There is also an attachment point 28 for a shock cord 60 to securely connect to mount 20. The receiving head 22 may have a grooved peg-like section 26 that can be inserted into a hole in the ladder as shown in FIGS. 5-10. The grooves 28 aid in holding the ladder to the receiving head 22 during removal and insertion of the ladder. Receiving head 22 has slot or hole 23 for a bolt or other connector that attaches head 22 to the sliding mount 20.

In alternate embodiments, other types of strut 10 may be used, for example, a unistrut, a b-line strut and kindorf and any other type of strut or similar device.

In one form of the invention, rack 5 can hold a variety of different types of ladders, such as for example, an "A" frame ladder. Other ladders such as extension ladders, step ladders, collapsible ladders and other types of ladders may be held by rack 5. The ladders may be made of any type of material such as for example, fiberglass, wood, aluminum or any other material that a ladder is constructed of. Two racks 5 may be placed side-by-side and an extension ladder may be mounted on the two racks 5. Extension ladders generally have two fixed ladders joined to create a longer ladder. Further two racks 5 may be used simultaneously to hold a collapsible ladder which has multiple pieces that nest together and lock into place when extended. In one embodiment, strut 10 may not be supplied with rack 5. In these instances, strut 10 may be existing in the space in which racks will be installed. Further, strut 10 may be supplied separately.

In one embodiment, the fixed mount 30 is designed to be attached firmly to strut 10 by means of bolting through holes 34 in the top portion of mount 30. The lower portion has a grooved mating surface 36 to prevent slippage with the adjustable catch head 32. Head 30 also has a slot 38 to accommodate a bolt or other connector that secures the adjustable catch head 32 to the mount 30. The catch 33 has a "V" shape that physically mates with and holds the rung or rung support of the ladder notches to accommodate the ladder rungs when the ladder is stored with the sides vertical. Catch 33 is wide enough to firmly hold the ladder rung within the "V" and prevent the ladder from falling or twisting when the vehicle is in transit. The adjustable catch 33 could be made of a variety of materials. It could be made adjustable or non-adjustable for different types of ladders or other equipment. It could be built to look different but still perform the same task(s) and operate the same. It could be fastened to the catch hose 32 in a variety of ways. In alternate embodiment, the fixed mount 30, catch head 32 and catch 33 can be made of a variety of materials. The can also have different attachment points for shock cord 60. It can be made adjustable or non-adjustable for different types of ladders or other equipment. They can be constructed to look different but still perform the same task(s) and operate in substantially the same manner. They can be constructed to use a different type of strut.

In one embodiment, the rear stop 40 may be a large square washer 1-⅝" by 1-⅝" that attaches to strut 10 with standard mounting hardware and limits the backward motion of the front sliding mount 20. In yet another embodiment, the fraont stop 46 may be a large square washer 1-⅝" by 1-⅝" that attaches to strut 20 with standard mounting hardware and limits the forward motion of sliding mount 20. In still other embodiments, stop 40 and stop 46 may be constructed of any size, shape and material that will provide for the necessary operation of rack 5 as described herein.

In one embodiment, connecting points 35 are provided for connecting shock cord 60 or other tension maintaining device that extends on either side of strut 10 and that serve to keep shock cord 60 up and away from the moving front mount 20 thereby allowing for the area to be clear of excess slack shock cord 60 when placing the ladder upon peg section 26 and sliding the ladder.

Sliding mount 20 can be made from plastic, metal or various other materials. It can have different attachment points for shock cord 60. It can be made adjustable or non-adjustable for different types of ladders or other equipment. It may be constructed to look different but still perform the same task(s) and operate substantially in the same manner. It could be designed to move using a different type of track. It may be designed to move using bearings or rollers. It can be designed to slide with applied coatings to the rail or to the mount itself. It could utilize something other than a shock cord to provide the holding tension.

The receiving head 22, in one embodiment, has a grooved peg 26 that can be inserted into the ladder as shown in FIGS. 5-10. The grooves 28 aid in holding the ladder to the receiving head 22 during removal and insertion of the ladder. Receiving head 22 has a hole 23 for a bolt that enables a connection to sliding mount 20 and a grooved mating surface to prevent slippage. The receiving head 22 can be made of a variety of materials, such as, for example, plastic, metal and a variety of other materials. It can be constructed so it is adjustable or non-adjustable for different types of ladders or other equipment. It can be built to look different but still perform the same task(s) and operate in substantially the same manner. It may also be fastened to the sliding mount 20 in a variety of different ways.

In one embodiment, an elastic shock cord 60 provides the tension between the sliding mount 20 and the fixed mount 30 to hold a ladder or other equipment securely in place. Cord 60 could be made of varying size, strengths and material. There may be one or more cords 60. It could be replaced entirely with any device that provides the holding/return force required to operate the present invention. In yet other embodiments, cord 60 may be removed and replaced by other devices capable of maintaining the applied tension, i.e., holding force, necessary to maintain a ladder in a secure fixed storage position as described herein. For example, some possible substitutes for cord 60 may be pneumatic devices or systems; hydraulic devices or systems; one or more springs; drawing cable(s); counter weights and pulleys; shock or bungee cords; electrically operated motors; magnets or a created magnet force; and/or screw type drive devices.

In one form of the invention, sliding mount 20 is inserted into the strut 10 channel between rails 15 where it can easily move forward and backward with respect to strut 10. The fixed mount 30 is securely attached to strut 10. The front stop 46 and rear stop 40 are fastened to strut 10 according to the position necessary for proper operation which will vary with different sizes and types of ladders and different equipment. The shock cord 60 attaches between the sliding mount 20 and fixed mount 30 through holes 29 and 31 formed in each. In different embodiments, rack 5 can be built in various sizes. It can use different materials for all components. It may be altered to hold many different types of equipment aside from ladders. The illustrated embodiment illustrates the 1-⅝" strut standard, however, any rail or strut dimension could be used provided the components are sized accordingly. In one form of the invention, rack 5 can hold a variety of different types of ladders, such as for example, an "A" frame. Other ladders such as extension ladders, step ladders, collapsible ladders and other types of ladders may be held by rack 5. The ladders may be made of any type of material such as for example, fiberglass, wood, aluminum or any other material that a ladder is made of. Two racks 5 may be placed side by side and an extension ladder may be mounted on the two racks 5. Extension ladders generally have two fixed ladders joined to create a longer ladder. Further two racks 5 may be used simultaneously to hold a collapsible ladder which has multiple pieces that nest together and lock into place when extended.

Figure 7:
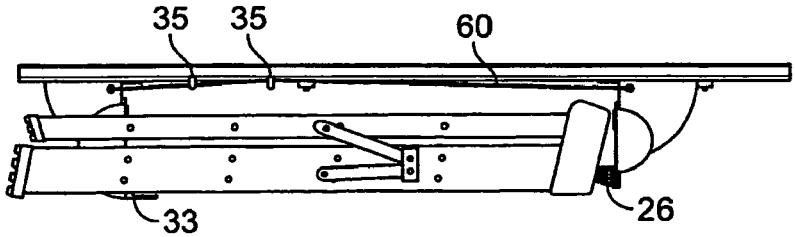
FIG. 7 is an operational side view of one embodiment of the invention with a ladder in the fully stowed horizontal position.
Figure 8:
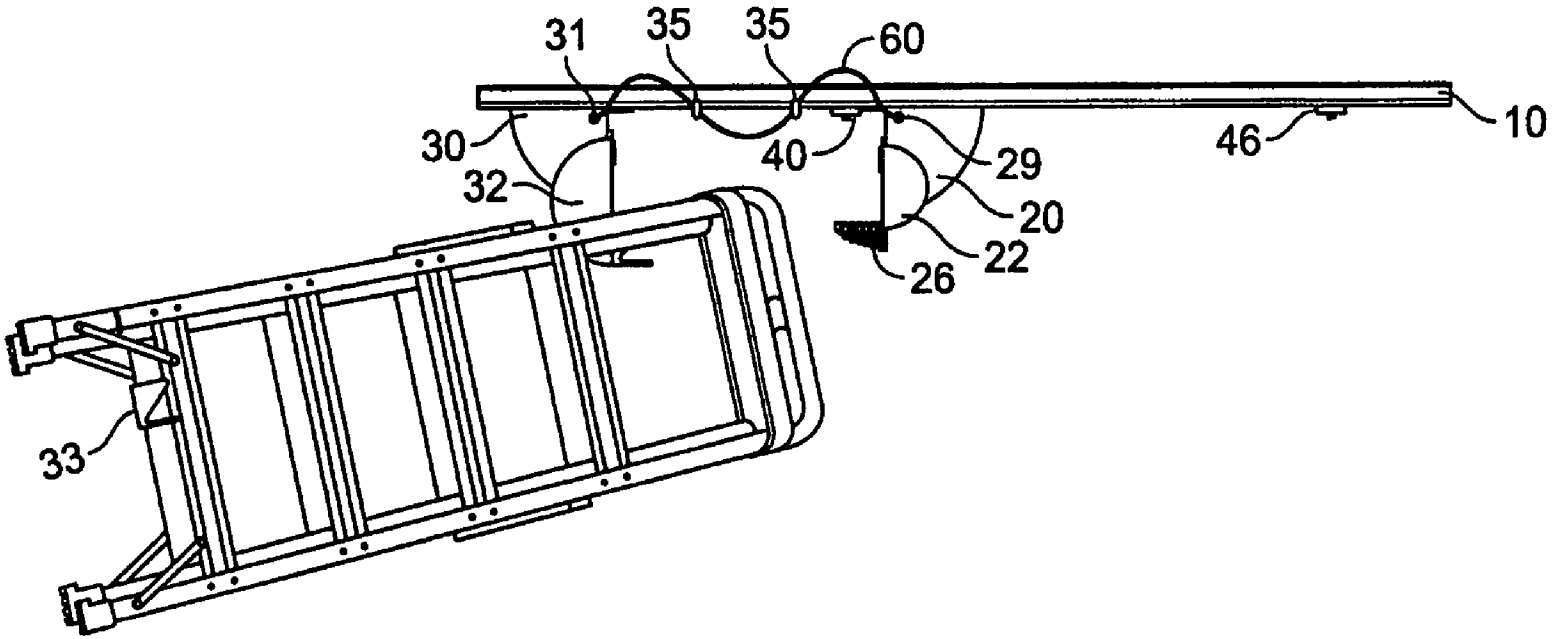
FIG. 8 is an operational side view of one embodiment of the invention with the sliding mount positioned at the rear stop.
Figure 9:
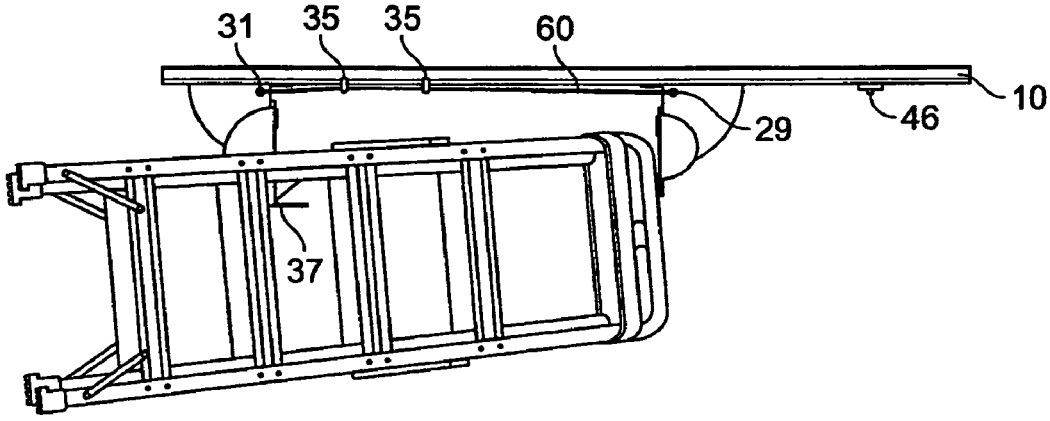
FIG. 9 is an operational side view of one embodiment of the invention with the sliding mount between the front and rear stop.
Figure 10:
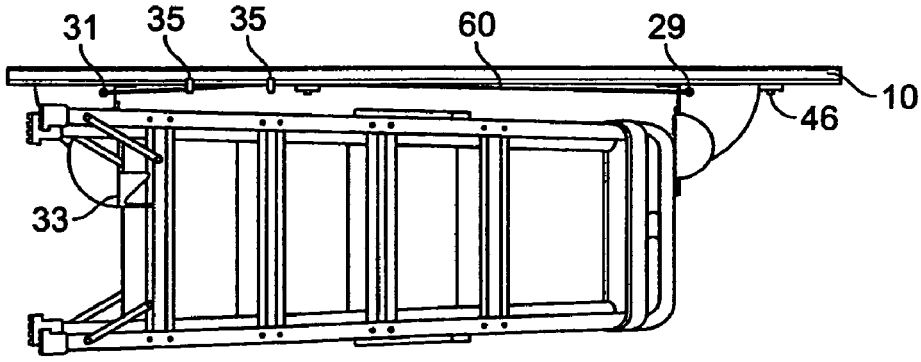
FIG. 10 is an operational side view of one embodiment of the invention with a ladder in the fully stowed vertical position.

In yet other forms of the invention, the rack 5 is not limited to holding only ladders but may be easily modified to accept aternate attachments such as receiving head 22, peg section 26, sliding mount 20, fixed mount 30, catch head 32, and catch 33. One or more of these attachments may be changed out or substituted for by a variety of different shaped holding devices to enable storage of different equipment, such as for example, recreational equipment, fishing rods, snow and water skis, recreational equipment, fishing rods, snow and water skis, canoes, kayaks, guns, golf bags, bicycles, hiking and camping gear, contractor/homeowner equipment, storage shelves, bins, hooks, conduit vendors, power tools, blueprints, and multiple other items. Rack 5 has the ability to mount different items without changing the basic function of the system. It is a modular and adjustable system that may accomplish a multitude of storage tasks. During use, as shown in FIGS. 5-10, the hole commonly found in the top platform of an "A frame" ladder and other types of ladders, is aligned with receiving pin 26. Without having to enter the vehicle, the operator moves the ladder away from himself/herself which causes the sliding mount 20 to move along rail 10 toward front stop 46. At this point, shock cord 60 starts to expand and the tension in the cord increases. As shown in FIG. 6, the sliding mount 20 or almost contacts the front stop 46 at which point the operator lifts the ladder and aligns the rung or rung support with catch 33. After alignment with catch 33, as shown in FIG. 7, the operator allows the tension of shock cord 60 to return the ladder to the fully stored and secure position. To remove the ladder from the stored position, the operator, simply reverses the process. The ladder is easily stored and removed from crowded and small storage spaces. In one embodiment, the user does not need to either enter the storage place and/or rearrange the other contents of the space to store or remove the ladder. The rack 5 accepts a wide variety of ladder brands and sizes by adjusting the mounting positions and/or providing alternate mounting positions. Further, in one embodiment, the various components as described above, such as for example, sliding front mount and fixed mount may be quickly and easily removed/detached from strut 10.

Specific embodiments of novel methods and apparatus for construction of novel sliding ladder racks according to the present invention have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

The invention claimed is:

1. A ladder storage rack that can be mounted to a surface, comprising:

at least one strut having first and second opposing ends, a top side, a bottom side and a means for substantially horizontally mounting the strut to said surface;

a sliding mount movably connected to the bottom of the at least one strut that slideably moves between the first and second ends of the strut;

a fixed mount attached to the at least one strut between the sliding mount and one of the first and second ends;

a peg extending towards the fixed mount from the sliding mount, said peg being adapted to engage an aperture in a top platform of a ladder, said peg having a plurality of grooves to aid in holding the ladder to the sliding mount; and a means for providing tension connected to the sliding mount, wherein the means for providing tension is a bungee cord and wherein a first end of the bungee cord is operably connected to the sliding mount and a second end of the bungee cord is operably connected to the fixed mount and wherein an area along the strut between the fixed and sliding mount is unobstructed for attaching a ladder between the fixed and sliding mounts with a longitude of the ladder parallel to the strut.

2. A ladder storage rack for mounting to a strut whereby the strut has first and second opposing ends, a top side and a bottom side and the strut top side is horizontally mounted to a surface, comprising:

a movable mount attached to the strut bottom side to enable the mount to move along at least a portion of the horizontally mounted strut between the first and second ends;

a fixed mount removably attached to the strut bottom side between the movable mount and at least one of the first and second ends;

a peg extending towards the fixed mount from the sliding mount, said peg being adapted to engage an aperture in a top platform of a ladder, said peg having a plurality of grooves to aid in holding the ladder to the movable mount; and a means for providing tension connected to the movable mount, wherein the means for providing tension is a bungee cord and wherein the first end of the bungee cord is operably connected to the sliding mount and a second end of the bungee cord is operably connected to the fixed mount and wherein an area along the strut between the movable mount and fixed mount is unobstructed for attaching a ladder with a longitude of the ladder parallel to the strut.

3. A ladder storage rack for a ladder that can be mounted to a surface, comprising:

at least one strut having first and second ends, a top side, a bottom side and a means for mounting to said surface;

a means for holding a first end of the ladder whereby the means for holding is slideably connected to the strut bottom side and wherein the means for holding slideably moves between the first and second ends of the strut; and a means for holding a second end of the ladder whereby the means for holding the second end is removably connected to the strut and is located between the means for holding and one of the first and second ends;

a peg extending towards the means for holding the second end from the means for holding the first end, said peg being adapted to engage an aperture in a top platform of a ladder, said peg having a plurality of grooves to aid in holding the ladder to the means for holding the first end; and a means for providing tension connected to the means for holding a first end and wherein an area along the strut between the means for holding the first and second ends is unobstructed for attaching a ladder between the means for holding the first and second ends with a longitude of the ladder parallel to the strut.

4. The ladder storage rack of claim 3 further comprising one or more stopping means attached to the strut to limit the movement of the means for holding the first end along the strut.

5. The ladder storage rack of claim 3 further comprising a receiving head joined to the means for holding the first end.

6. The ladder storage rack of claim 3 further comprising a catch head joined to the fixed mount.

7. The ladder storage rack of claim 6 further comprising a catch connected to the catch head and wherein the catch can accept and hold the ladder rung.

8. A storage rack for holding equipment whereby the rack is mounted to a strut that is fixed to a surface and whereby the strut has first and second ends, a top side and a bottom side, comprising:

a means for holding a first end of the equipment whereby the means for holding is slidably connected to the strut and slides between the first and second ends of the strut;

a means for holding a second end of the equipment whereby the means for holding the second end is removably connected to the strut to one of the first and second ends of the strut;

a peg extending towards the means for holding the second end from the means for holding the first end, said peg being adapted to engage an aperture in a top platform of a ladder, said peg having a plurality of grooves to aid in holding the ladder to the means for holding the first end; and a means for providing tension connected to the means for holding the first end that pulls the means for holding the first end towards the mean for holding the second end and wherein an area along the strut between the means for holding the first end and means for holding the second end is unobstructed for attaching a ladder between the means for holding the first end and the means for holding the second end with a longitude of the ladder parallel to the strut.

9. A ladder storage rack that can be mounted to an elevated surface comprising:

at least one strut having a top, a bottom side and a means for mounting the top side to the elevated surface;

a fixed mount attached to the bottom side of the at least one strut on a first end;

a sliding mount disposed below the at least one strut that slidably moves along the at least one strut between a second, opposing end of the strut and the first end of the strut;

a peg extending towards the fixed mount from the sliding mount, said peg being adapted to engage an aperture in a top platform of a ladder, said peg having a plurality of grooves to aid in holding the ladder to the sliding mount; and a shock cord that urges the sliding mount towards the fixed mount and wherein an area along the strut between the fixed mount and sliding mount is unobstructed for attaching a ladder between the fixed and sliding mounts with a longitude of the ladder parallel to the strut.

* * * * *